US011839967B1

(12) United States Patent
Keller

(10) Patent No.: US 11,839,967 B1
(45) Date of Patent: Dec. 12, 2023

(54) TOOL FOR MARKING SHEET METAL AND METHOD OF USE

(71) Applicant: Paul Hyman Keller, Midlothian, VA (US)

(72) Inventor: Paul Hyman Keller, Midlothian, VA (US)

( * ) Notice: Subject to any disclaimer, the term of this patent is extended or adjusted under 35 U.S.C. 154(b) by 0 days.

(21) Appl. No.: 18/200,027

(22) Filed: May 22, 2023

(51) Int. Cl.
*B25H 7/04* (2006.01)
*B43L 7/02* (2006.01)

(52) U.S. Cl.
CPC ..... *B25H 7/045* (2013.01); *B43L 7/02* (2013.01)

(58) Field of Classification Search
CPC .. B25H 7/045; B25H 7/02; B25H 7/04; B43L 7/00; B43L 7/02; B43L 7/027; B43L 13/02; G01B 3/002; G01B 3/004; G01B 3/02
USPC ..... 33/42, 32.1, 32.2, 32.3, 41.1, 41.4
See application file for complete search history.

(56) References Cited

U.S. PATENT DOCUMENTS 6,049,990 A * 4/2000 Holland ..... B43L 7/02 33/468
6,141,882 A * 11/2000 Syken ..... B43L 7/12 33/465
9,259,958 B2 * 2/2016 Chernyshou ..... B43L 7/12
2015/0168122 A1 * 6/2015 Cruickshanks ..... G01B 5/24 33/425

* cited by examiner

*Primary Examiner* — Phong H Nguyen
(74) *Attorney, Agent, or Firm* — Ted Masters

(57) ABSTRACT

A tool for marking sheet metal prior to bending in a bending brake, includes a scale having a first end, an opposite second end, a longitudinal axis, and four faces. Each of the four faces include a plurality of marking stations. A cross member is rotatably connected to the first end of the scale. The cross member has a surface which is disposed perpendicular to the longitudinal axis, and is configured to abut the edge of the sheet of metal. The tool is positioned at a first location on the sheet of metal and marks are made at the marking stations. The tool is then moved to a second location on the sheet of metal and a second set of marks are made. The two sets of marks are used to align the sheet of metal with the bend line of a bending brake so that accurate bends can be made.

17 Claims, 15 Drawing Sheets

TOOL FOR MARKING SHEET METAL AND METHOD OF USE

CROSS REFERENCE TO RELATED APPLICATION

None

Technical Field

The present invention pertains generally to the building industry, and more particularly to a tool for marking a piece of sheet metal prior to bending in a bending brake.

BACKGROUND OF THE INVENTION

It is known in the building industry to clad (cover) wooden members with a thin skin of metal such as aluminum. The cladding provides thermal insulation, weather resistance, and can serve to improve the appearance of a structure. In one application elongated wooden members such as 2 by 4s, 4 by 4s, and the like are clad with sheet metal. The sheet metal is formed in a bending brake into bent strips which surround the wooden members. A problem can exist however if the sheet metal is not properly aligned with the bend line of the bending brake. Such a misalignment will result in sheet metal strips which will not properly cover the wooden members.

BRIEF SUMMARY OF THE INVENTION

The present invention is directed to a tool and method for accurately marking sheet metal for bending in a bending brake. The tool includes a scale which has multiple faces. The scale is rotatably connected to a cross member which is placed in abutting relationship with the edge of the sheet metal. The four faces of the scale include marking stations for marking the sheet of metal at cut. first bend, and second bend locations. Two sets of spaced apart marks are made on the sheet of metal, which allows the sheet of metal to be accurately aligned with the bend line of the bending brake. After cutting and bending, the sheet of metal has a U shape. Two U-shaped pieces of sheet metal are then placed in overlapping relationship around a wooden member.

In accordance with an embodiment, a tool for marking sheet metal having an edge prior to bending in a bending brake includes a scale which has a first end, an opposite second end, a longitudinal axis, and four faces. Each of the four faces include a plurality of marking stations. A cross member is rotatably connected to the first end of the scale, the cross member has a surface which is disposed perpendicular to the longitudinal axis, and is configured to abut the edge of the sheet of metal.

In accordance with another embodiment, the surface includes a first surface and a second surface spaced apart from the first surface. A flange outwardly projects parallel to the longitudinal axis from the surface. The second surface is disposed between the scale and the flange.

In accordance with another embodiment, the flange has has a centrally disposed notch.

In accordance with another embodiment, a screw rotatably connects the cross member to the first end of the scale, the screw is oriented along the longitudinal axis of the scale. A nut is inset into the first end of the scale and engages the screw.

In accordance with another embodiment, the plurality of marking stations are V-shaped notches.

In accordance with another embodiment, the marking stations include a set of three marking stations, one marking station being a cut, another marking station being a first bend, and another marking station being a second bend.

In accordance with another embodiment, at least one face of the four faces including two sets of three marking stations.

In accordance with another embodiment, the marking stations include one marking station set for use with a 2" by 4" wooden member, one marking station set for use with a 2" by 2" wooden member, two marking station sets for use with a 3" by 3" wooden member, and two marking station set for use with a 4" by 4" wooden member.

Other embodiments, in addition to the embodiments enumerated above, will become apparent from the following detailed description, taken in conjunction with the accompanying drawings, which illustrate, by way of example, the principles of the tool and method of use.

DETAILED DESCRIPTION OF THE INVENTION

Figure 17:
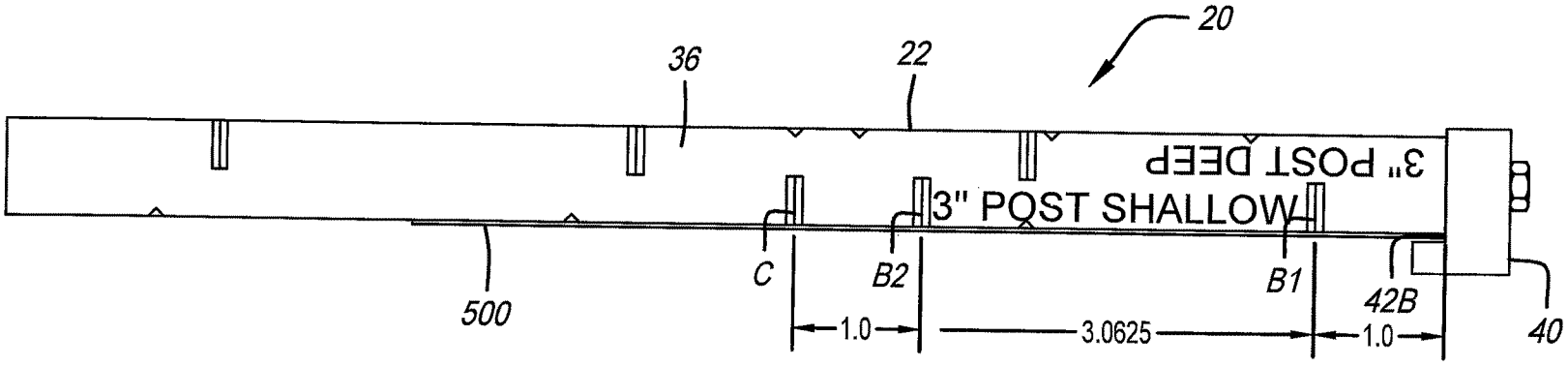
FIG. 17 is a side elevation view of the fourth face of the tool showing dimensions of marking stations.
Figure 20:
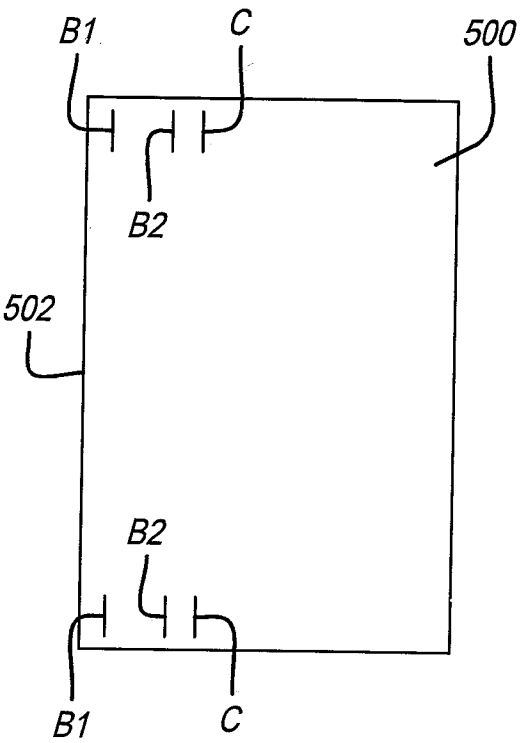
Figure 19:
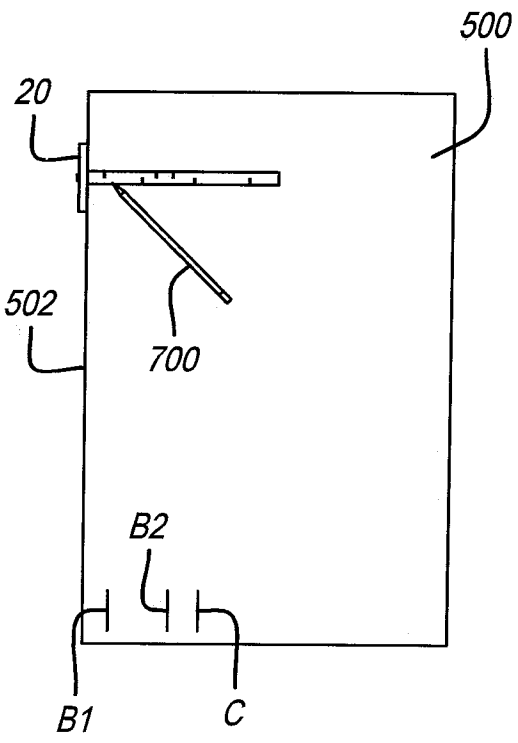
FIG. 19 is a second reduced top plan view of the tool and piece of sheet metal showing marks; and, FIG. 20 is a third reduced top plan view of the tool and piece of sheet metal showing alignment marks.
Figure 18:
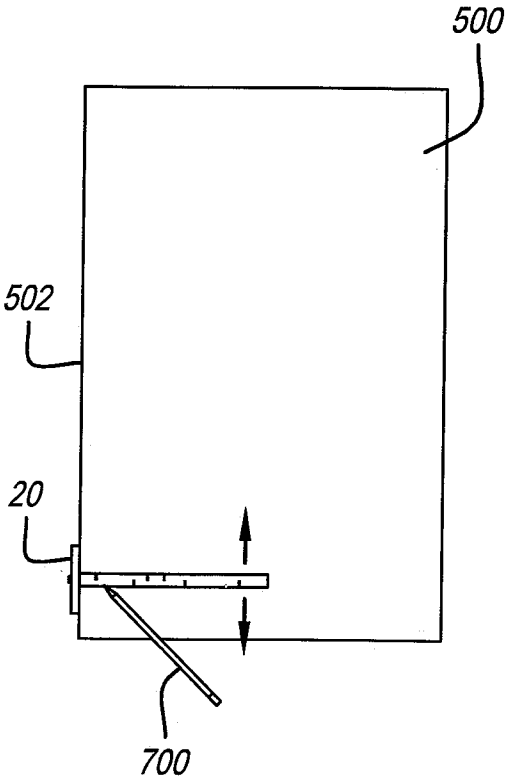
FIG. 18 is a reduced top plan view of the tool and a piece of sheet metal.

Referring initially to FIGS. 1-7 there are illustrated various views of a tool 20 for marking a piece of sheet metal 500 having and edge 502 prior to bending in a bending brake (also refer to FIGS. 18-20). In one embodiment piece of sheet metal 500 has a thickness of about 1/32 of an inch. Tool 20 includes a scale 22 which has a first end 24, a second end 26, a longitudinal axis 28, and four faces (first face 30, second face 32, third face 34, and fourth face 36. Each of the four faces 30-36 include a plurality of marking stations 38. In the shown embodiment markding stations are V-shaped grooves in scale 22. The marking stations 38 are designated C (cut), first bend (B1), and second bend *B2). A cross member 40 is rotatably connected to first end 24 of scale 22. Cross member 40 has a surface 42 which is disposed perpendicular to longitudinal axis 28. Scale 22 can be rotated about longitudinal axis 28 with respect to cross member 40 to one of four positions, wherein each of the four positions two of the four faces 30-36 are disposed perpendicular to the piece of sheet metal 500 (refer to FIGS. 10-17). For example in the position of FIG. 1 first face (and third face 34) are perpendicular to sheet of metal 500.

Figure 1:
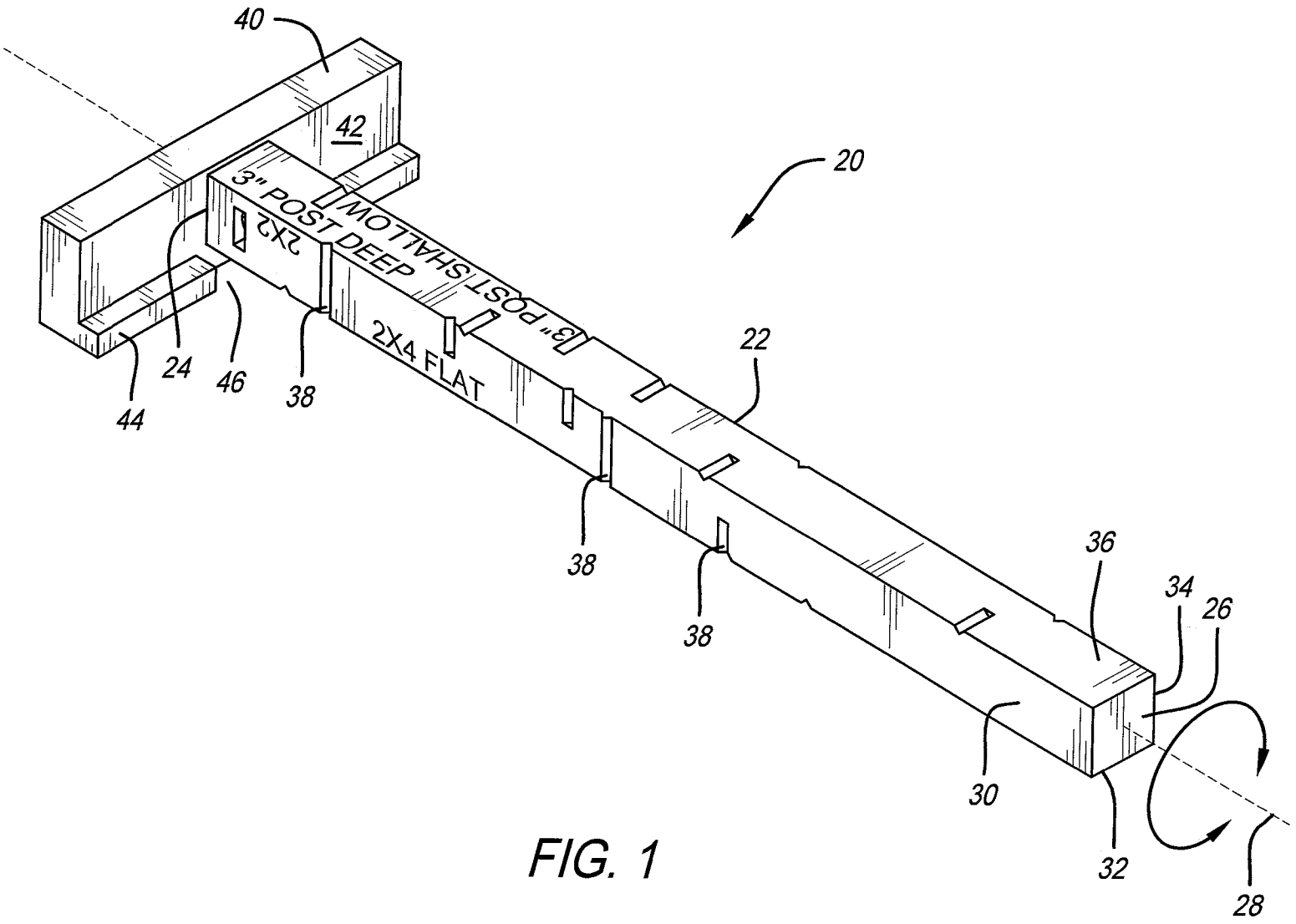
FIG. 1 is a perspective view of a tool for marking sheet metal.
Figure 2:
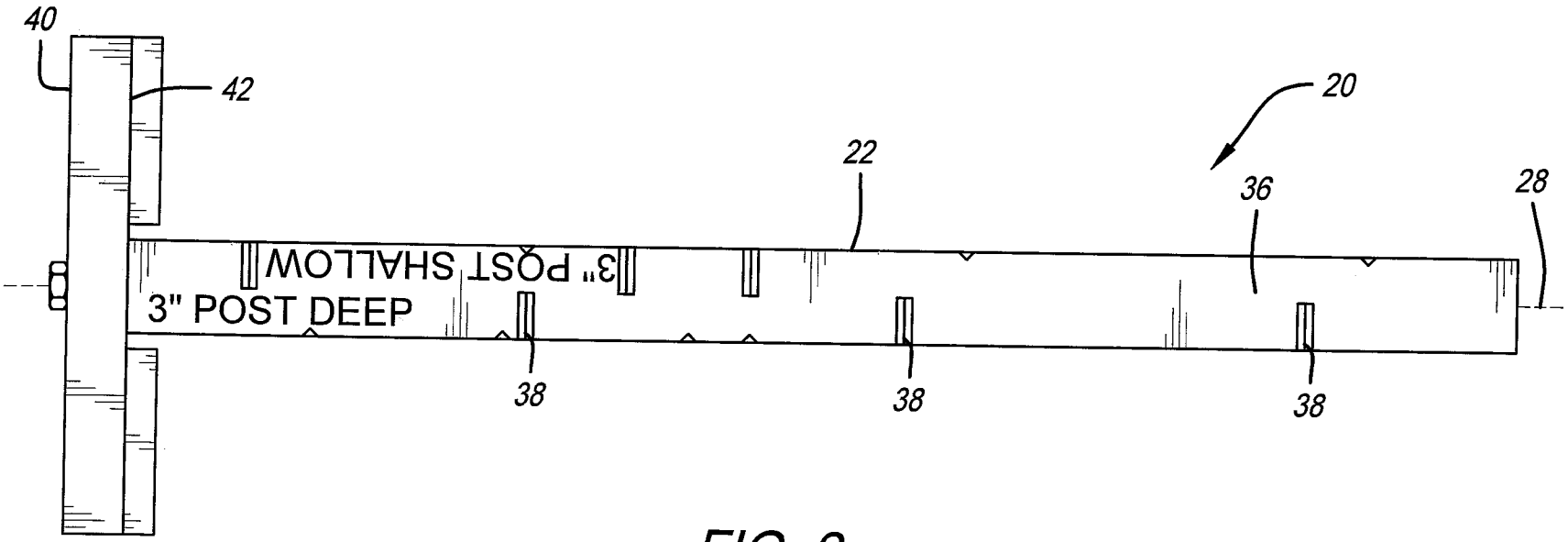
FIG. 2 is a top plan view of the tool.
Figure 3:
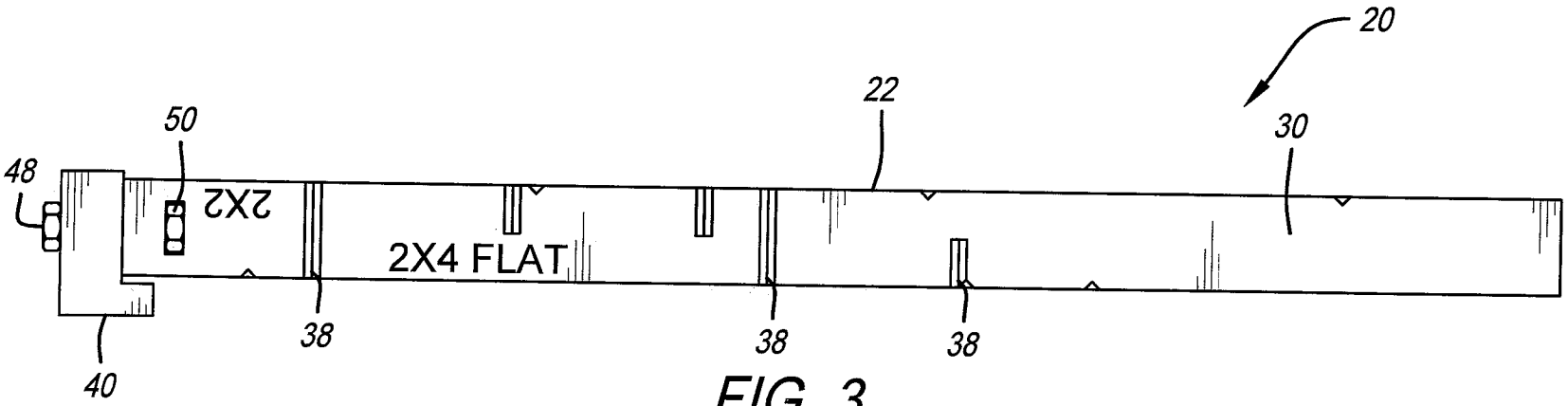
FIG. 3 is a side elevation view of the tool.
Figure 4:
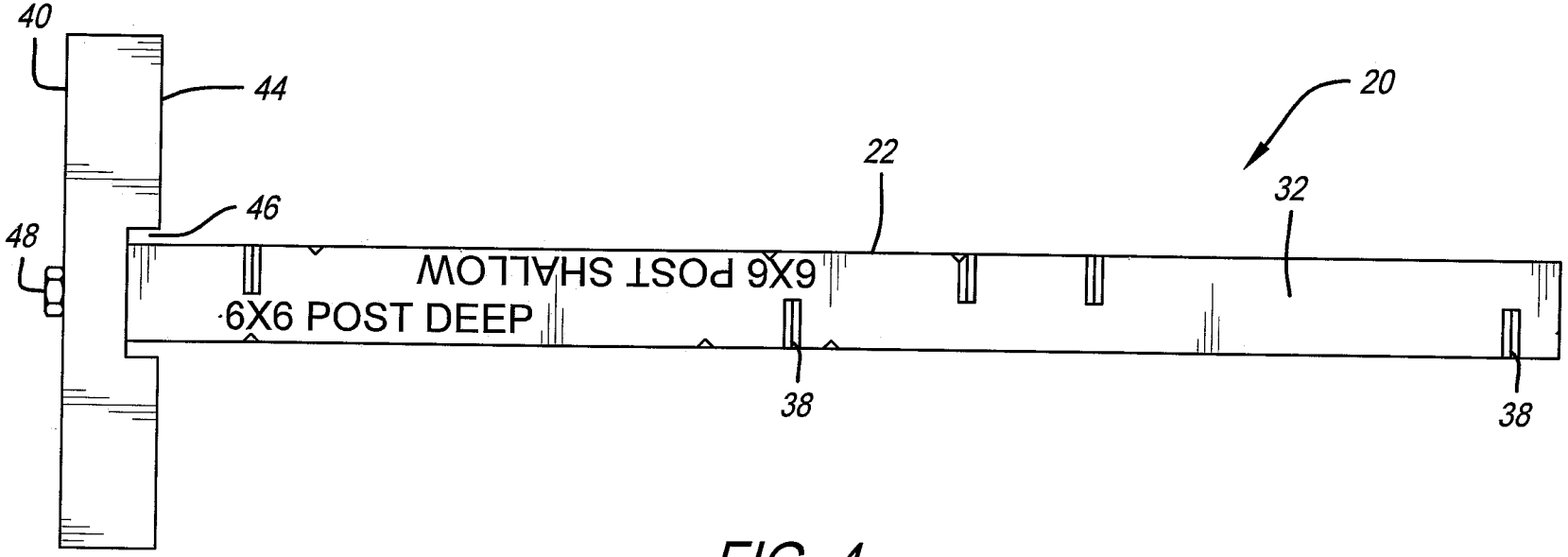
FIG. 4 is a bottom plan view of the tool.
Figure 5:
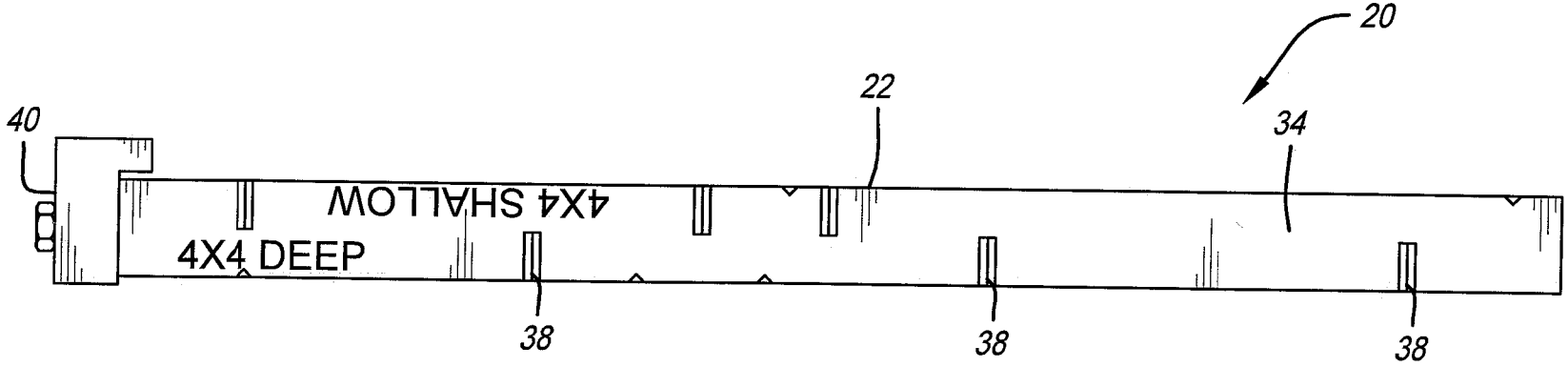
FIG. 5 is an opposite side elevation view of the tool.
Figure 7:
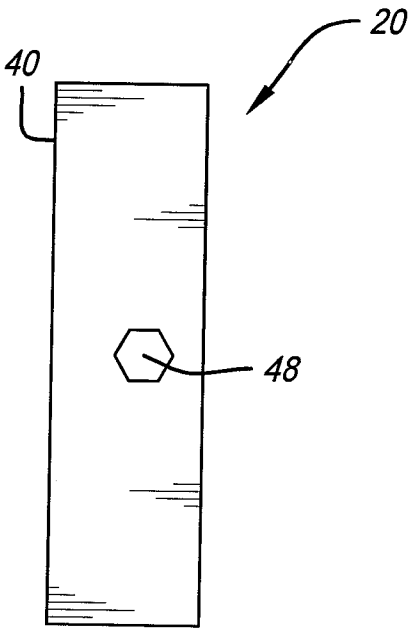
FIG. 7 is an opposite end view of the tool.
Figure 6:
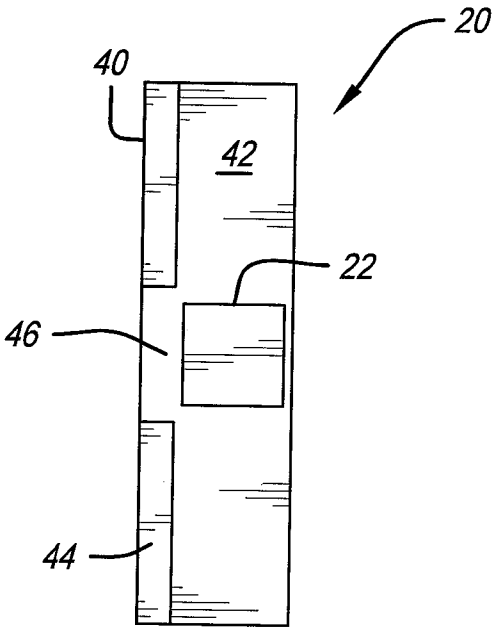
FIG. 6 is an end elevation view of the tool.
Figure 8:
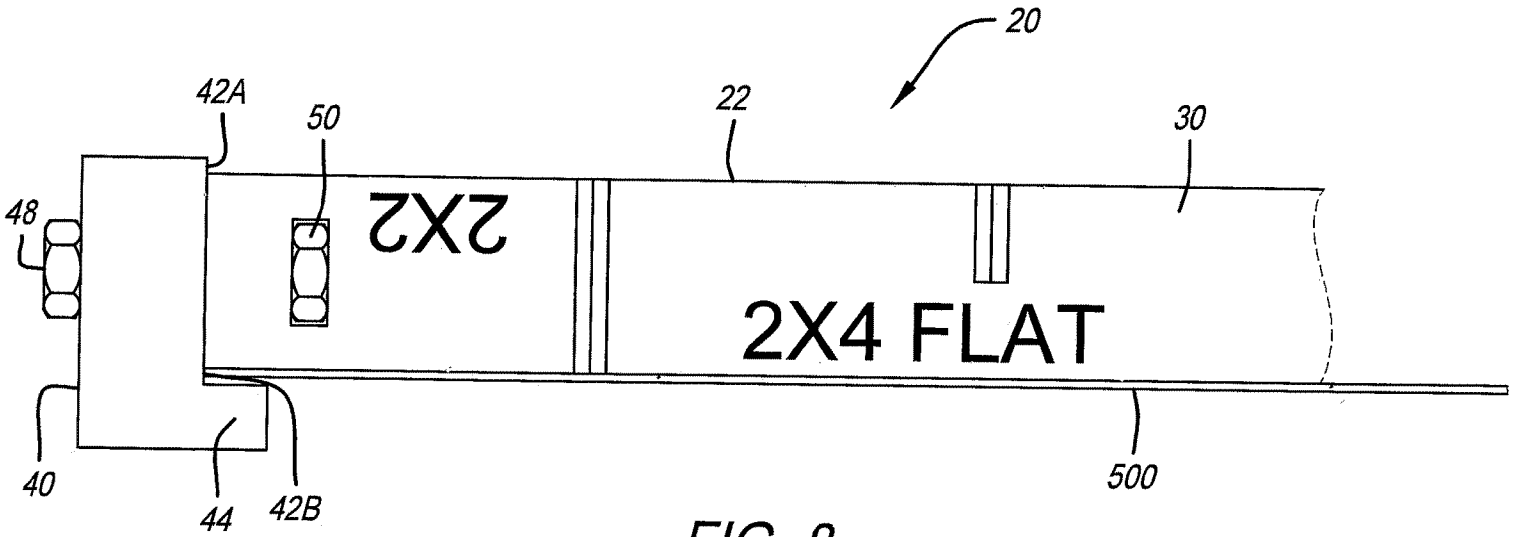
FIG. 8 is an enlarged fragmented side elevation view of the tool and a piece of sheet metal.
Figure 9:
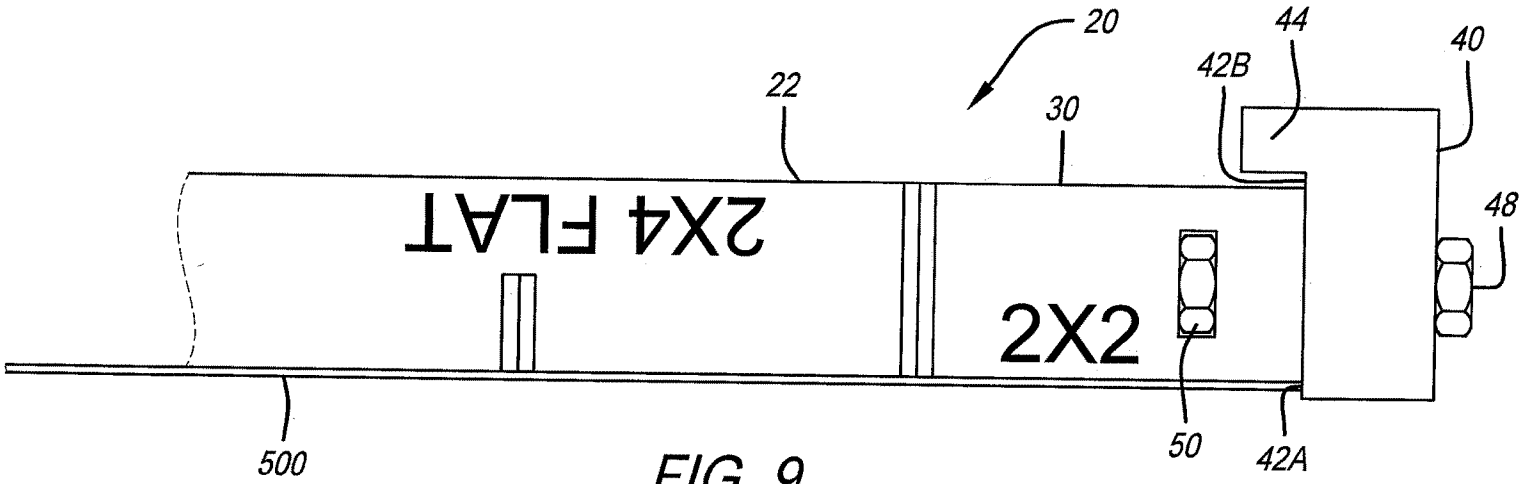
FIG. 9 is another enlarged fragmented side elevation view of the tool and a piece of sheet metal.

Also referring to FIGS. 8 and 9, surface 42 includes a first surface 42A and a second surface 42B spaced apart from first surface 42A. A flange 44 outwardly projects parallel to longitudinal axis 28 from surface 42. Referring specifically to FIG. 8, second surface 42B is disposed between scale 22 and flange 44. In use tool 20 is positioned so that one of first surface 42A (FIG. 8) and second surface 42B (FIG. 9) of cross member 40 is in abutting contact with edge 502 of sheet of metal 500. The configuration of FIG. 9 is used when sheet of metal 500 lays flat on a support surface, while the configuration of FIG. 8 is used when sheet of metal 500 is unsupported.

Flange 44 has a centrally disposed notch 46. Notch 46 is necessary so that scale 22 can rotate with respect to cross member 40. A screw 48 rotatably connects cross member 40 to first end 24 of scale 22, and is oriented along longitudinal axis 28 of scale 22. Referring to FIGS. 8 and 9 nut 50 is inset into first end 24 of scale 22 and engages screw 48 (refer to FIG. 3).

FIGS. 10-17 are side elevation views of each face of tool 20 showing the dimensions of the various marking stations 38. The figures also show end views of a piece of sheet metal 500 which has been bent at the various marking stations 38, and the bent pieces of sheet metal 500 placed around various wooden members 600.

Figure 10:
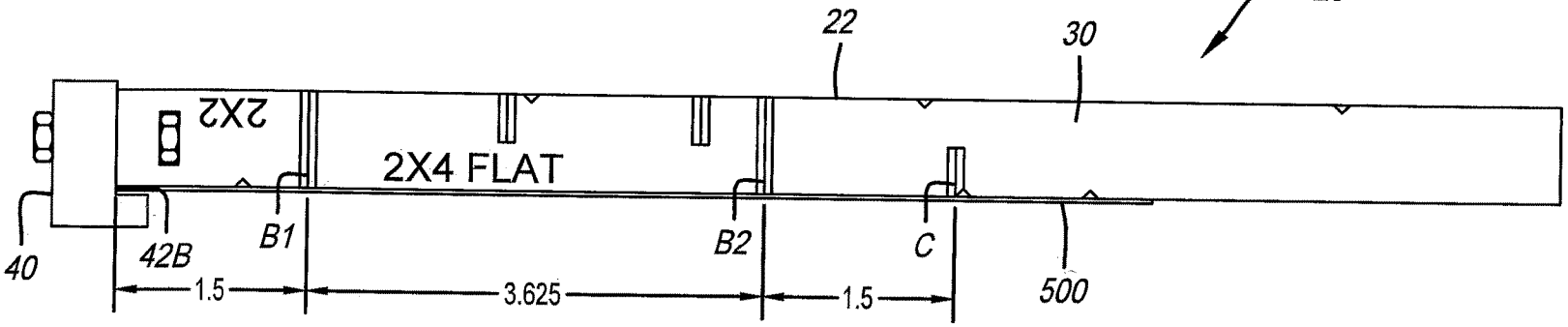
FIG. 10 is a side elevation view of a first face of the tool showing dimensions of marking stations.
Figure 10B:
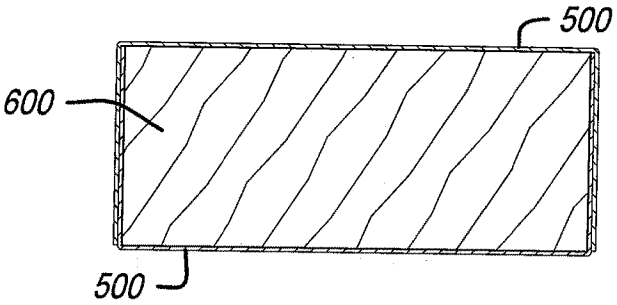
FIG. 10B is an end view of two pieces of sheet metal which have been bent at the bend lines of FIG. 10 and placed around a 2" by 4" wooden member.
Figure 10A:
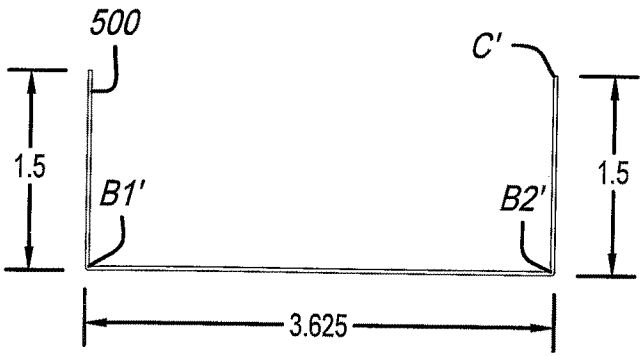
FIG. 10A is an end view of a piece of sheet metal which has been bent at the bend lines of FIG. 10.

In FIG. 10 first face 30 of tool is placed adjacent to and perpendicular with sheet of metal 500. It is noted that in FIGS. 10-17 the marking stations 38 are labeled with C for cut, B1 for first bend, and B2 for second bend. First bend marking station B1 is 1.5 inches from surface 42B which abuts the edge 502 of sheet of metal 500. Second bend marking station B1 is 1.5+3.625 inches from surface 42B. Cut marking station C is 1.5+3.625+1.5 inches from surface 42B. A marking implement 700 (refer to FIG. 18) is placed in the notched C, B1, and B2 marking stations to mark the sheet of metal 500 at those three locations (refer to FIGS. 18-20). FIG. 10A is an end view of a piece of sheet metal 500 which has been cut and bent at the locations C', B1'. and B2' of the three marking stations of FIG. 10. FIG. 10B shows two pieces of bent sheet metal 500 of FIG. 10A placed in overlapping relationship around a 2"×4" wooden member 600. It is noted in this embodiment that there is a set of exactly three marking stations C, B1, and B2.

Figure 11:
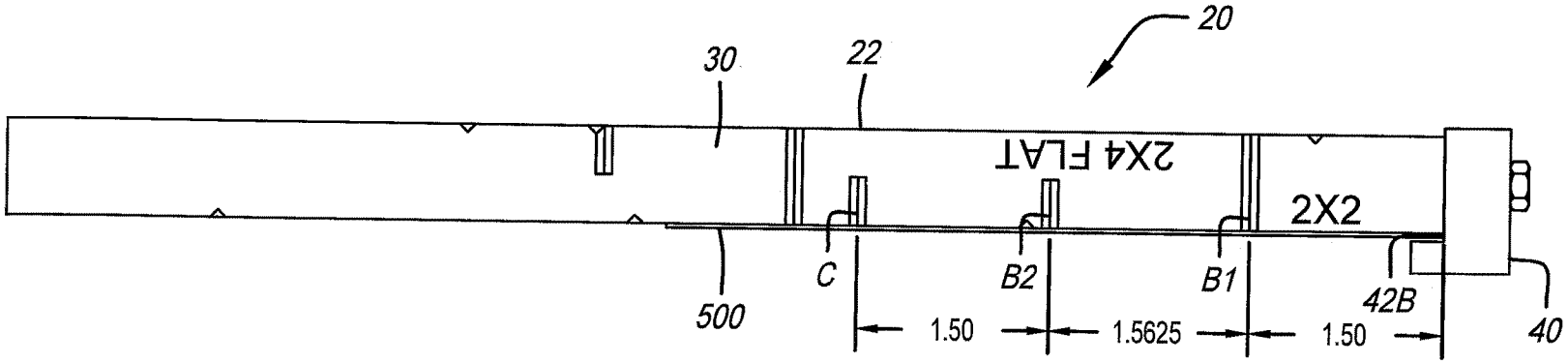
FIG. 11 is a side elevation view of the first face of the tool showing dimensions of marking stations.
Figure 11B:
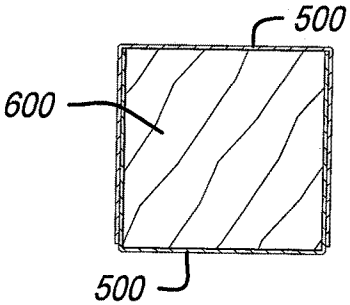
FIG. 11B is an end view of two pieces of sheet metal which have been bent at the bend lines of FIG. 11 and placed around a 2" by 2" wooden member.
Figure 11A:
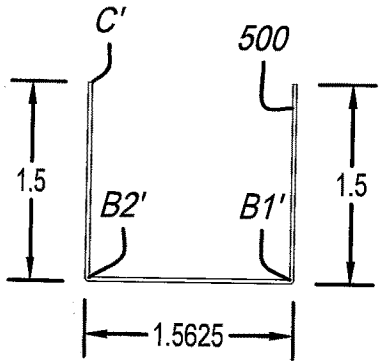
FIG. 11A is an end view of a piece of sheet metal which has been bent at the bend lines of FIG. 11.

In FIG. 11, scale 22 has been rotated 180° (from the position of FIG. 10) with respect to cross member 40 so that face 30 is again perpendicular to sheet of metal 500, and is viewed from the opposite side. Three marking stations C, B1, and B2 and their dimensions are shown. FIG. 12A is an end view of a piece of sheet metal 500 which has been cut and bent at the locations C', B1'. and B2' of the three marking stations of FIG. 11. FIG. 11B shows two pieces of bent sheet metal 500 of FIG. 11A placed in overlapping relationship around a 2"×2" wooden member 600.

Figure 12:
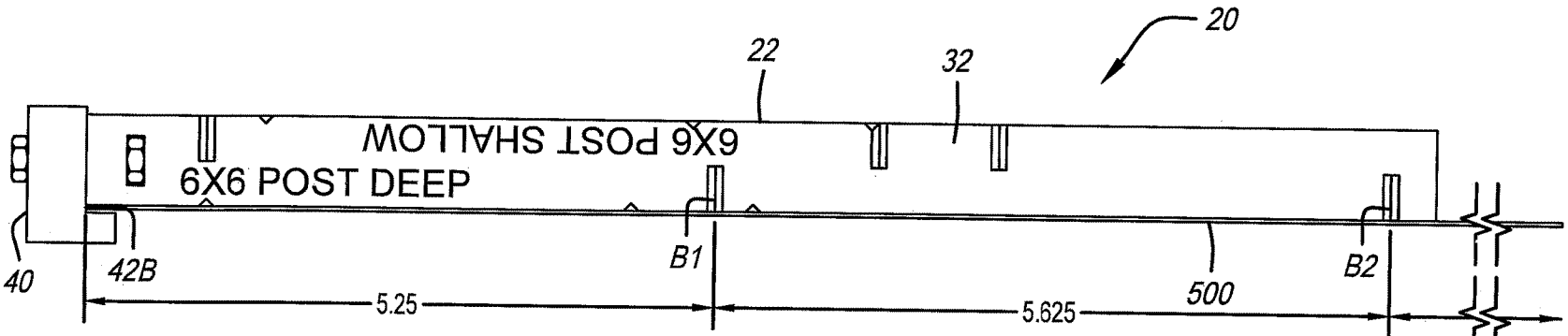
FIG. 12 is a side elevation view of a second face of the tool showing dimensions of marking stations.
Figure 12A:
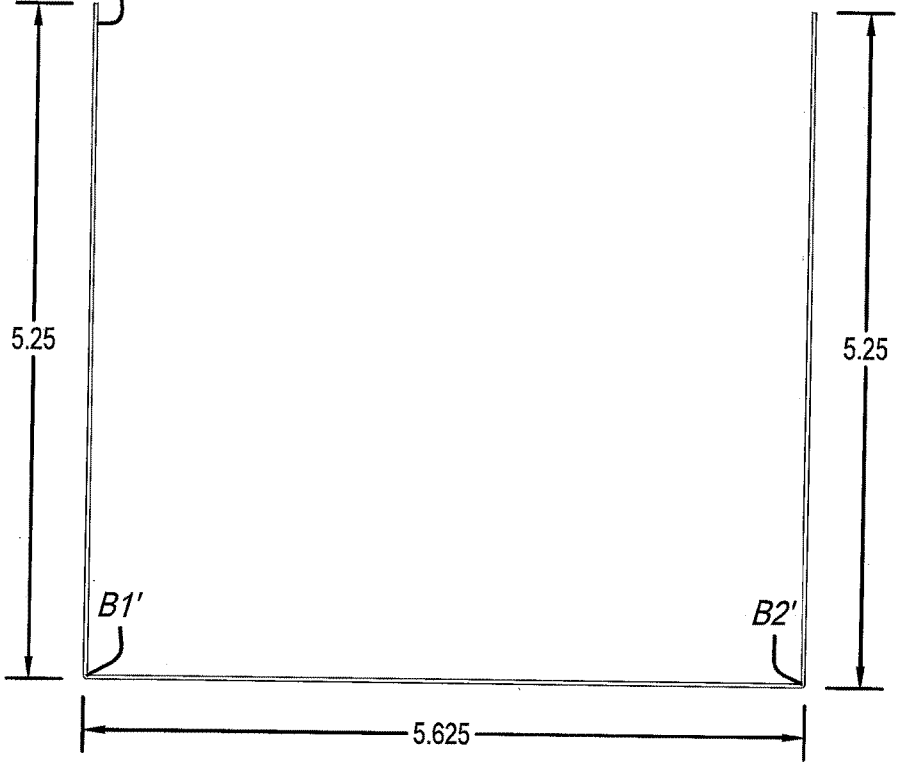
FIG. 12A is an end view of a piece of sheet metal which has been bent at the bend lines of FIG. 12.

In FIG. 12, scale 22 has been rotated 90° (from the position of FIG. 10) with respect to cross member 40 so that face 32 is now perpendicular to sheet of metal 500. Exactly two marking stations B1, and B2 and their dimensions are shown. In this embodiment cut marking station C is not required since a standard width for sheet of metal 500 is about 17 inches. FIG. 12A is an end view of a piece of sheet metal 500 which has been bent at the locations B1'. and B2' of the two marking stations of FIG. 12.

Figure 13:
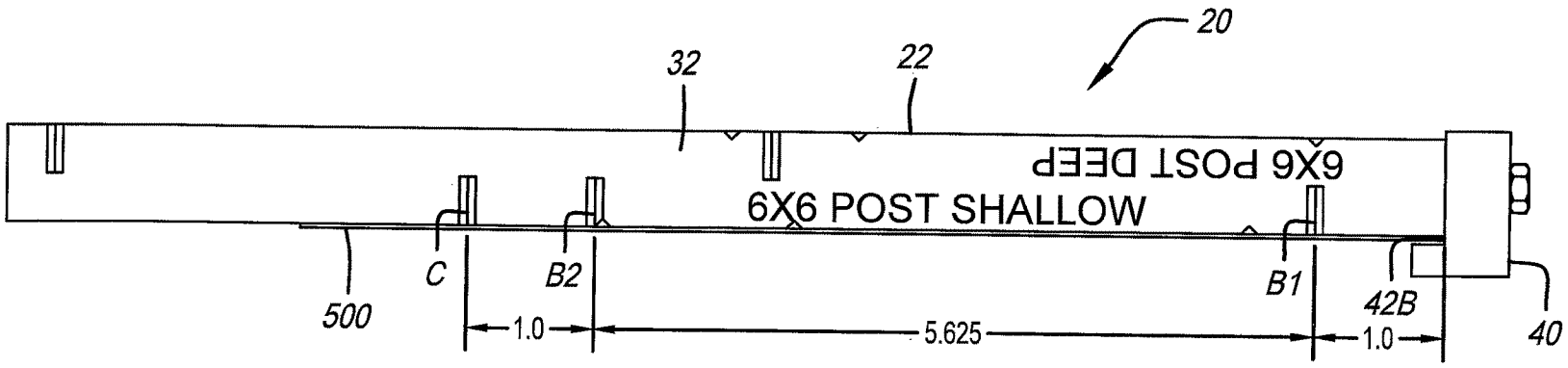
FIG. 13 is a side elevation view of the second face of the tool showing dimensions of marking stations.
Figure 13A:
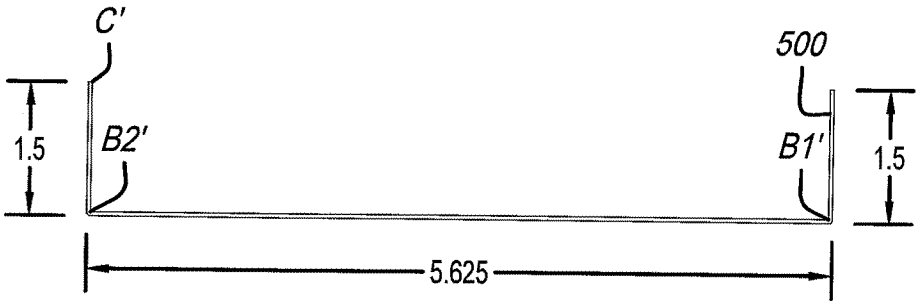
FIG. 13A is an end view of a piece of sheet metal which has been bent at the bend lines of FIG. 13.
Figure 13B:
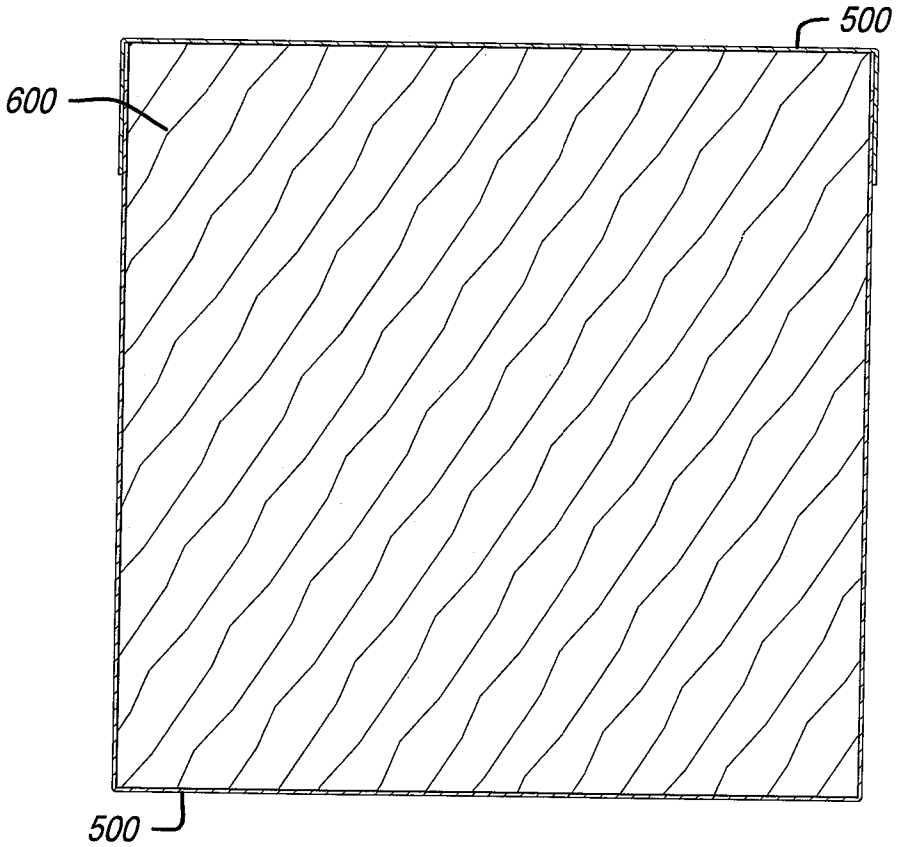
FIG. 13B is an end view of the piece of sheet metal of FIG. 13A and the piece of sheet metal of |FIG. 12A placed around a 6" by 6" wooden member.

In FIG. 13, scale 22 has been rotated 180° (from the position of FIG. 12) with respect to cross member 40) so that second face 32 is again perpendicular to sheet of metal 500, and is viewed from the opposite side. Three marking stations C, B1, and B2 and their dimensions are shown. FIG. 13A is an end view of a piece of sheet metal 500 which has been cut and bent at the locations C', B1'. and B2' of the three marking stations of FIG. 13. FIG. 13B shows the piece of sheet metal 500 of FIG. 12A and the piece of sheet metal 500 of FIG. 13A placed in overlapping relationship around a 6"×6" wooden member 600.

Figure 14:
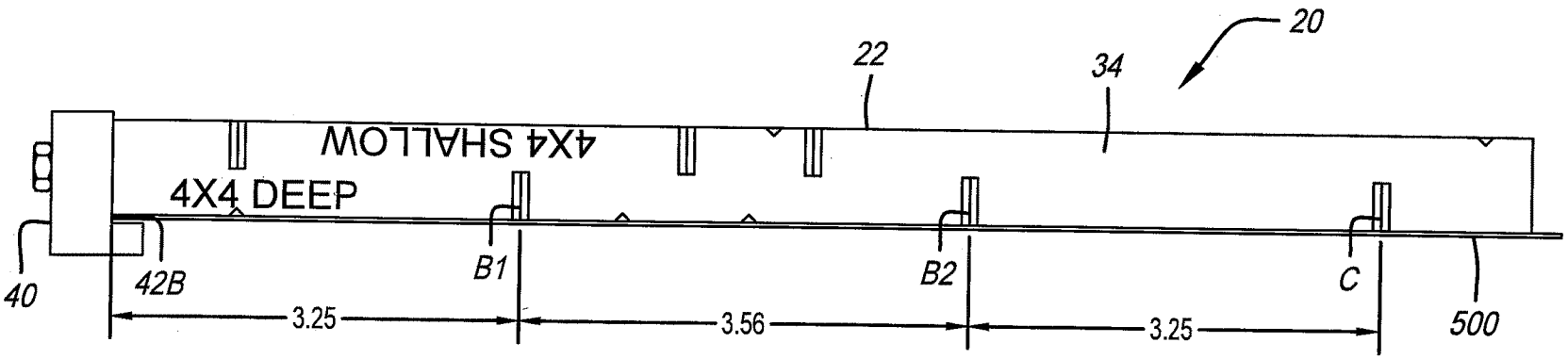
FIG. 14 is a side elevation view of a third face of the tool showing dimensions of marking stations.
Figure 14A:
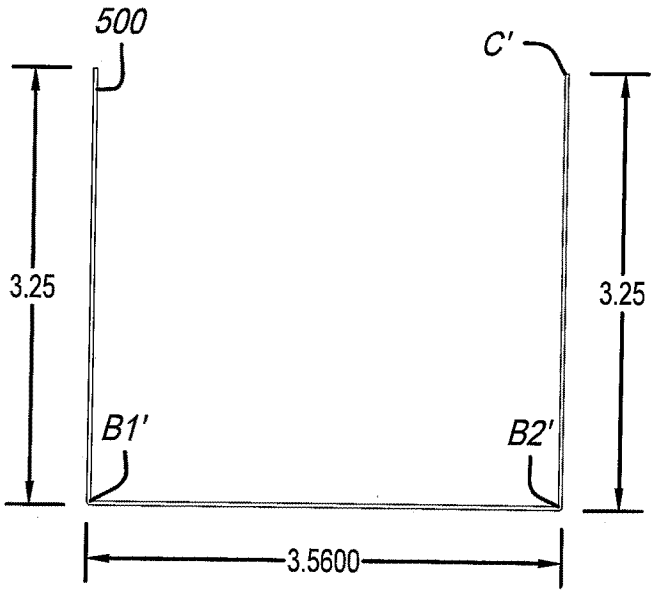
FIG. 14A is an end view of a piece of sheet metal which has been bent at the bend lines of FIG. 14.

In FIG. 14, scale 22 has been rotated 180° (from the position of FIG. 10) with respect to cross member 40 so that third face 34 is now perpendicular to sheet of metal 500. Three marking stations C, B1, and B2 and their dimensions are shown. FIG. 14A is an end view of a piece of sheet metal 500 which has been bent at the locations C', B1'. and B2' of the three marking stations of FIG. 14.

Figure 15:
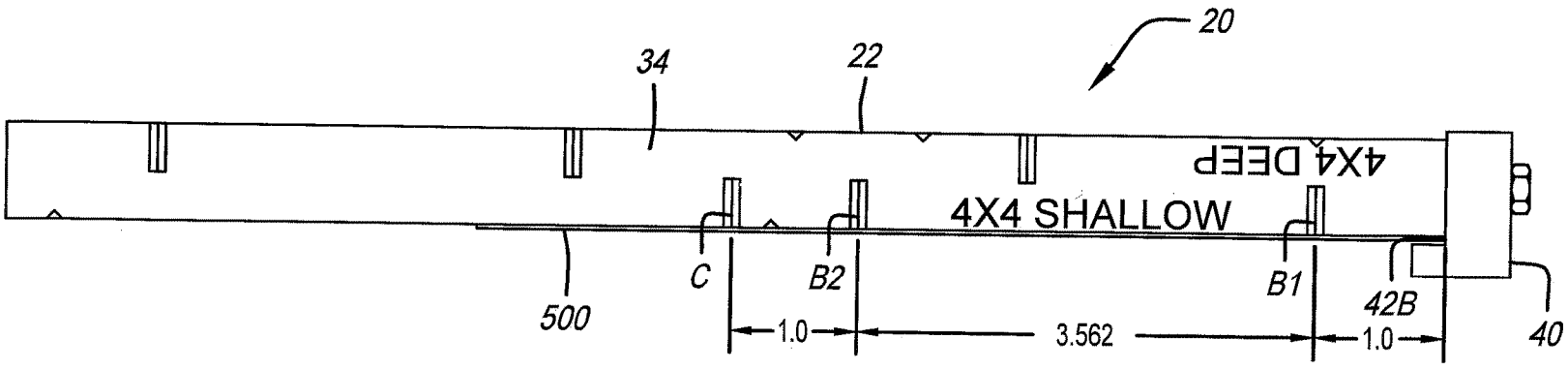
FIG. 15 is a side elevation view of the third face of the tool showing dimensions of marking stations.
Figure 15B:
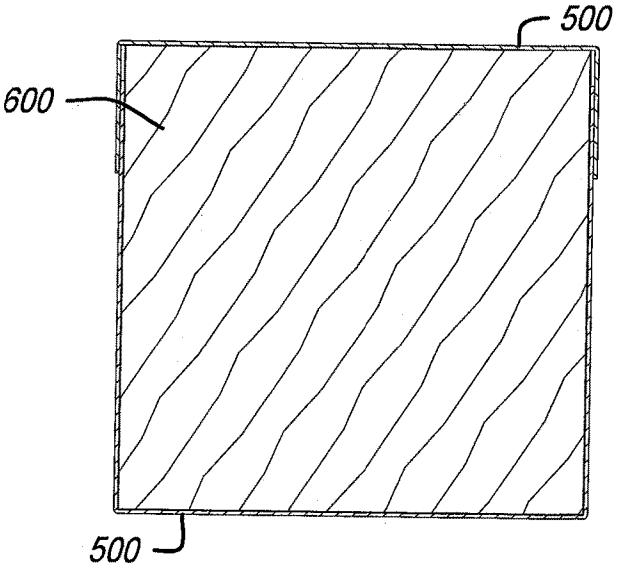
FIG. 15B is an end view of the piece of sheet metal of FIG. 14A and the piece of sheet metal of FIG. 15A placed around a 4" by 4" wooden member.
Figure 15A:
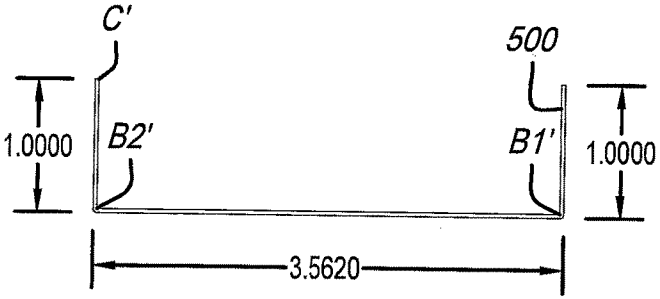
FIG. 15A is an end view of a piece of sheet metal which has been bent at the bend lines of FIG. 15.

In FIG. 15, scale 22 has been rotated 180° (from the position of FIG. 14) with respect to cross member 40 so that third face 34 is again perpendicular to sheet of metal 500, and is viewed from the opposite side. Three marking stations C, B1, and B2 and their dimensions are shown. FIG. 15A is an end view of a piece of sheet metal 500 which has been cut and bent at the locations C', B1'. and B2' of the three marking stations of FIG. 15. FIG. 15B shows the piece of sheet metal 500 of FIG. 14A and the piece of sheet metal 500 of FIG. 15A placed in overlapping relationship around a 4"×4" wooden member 600.

Figure 16:
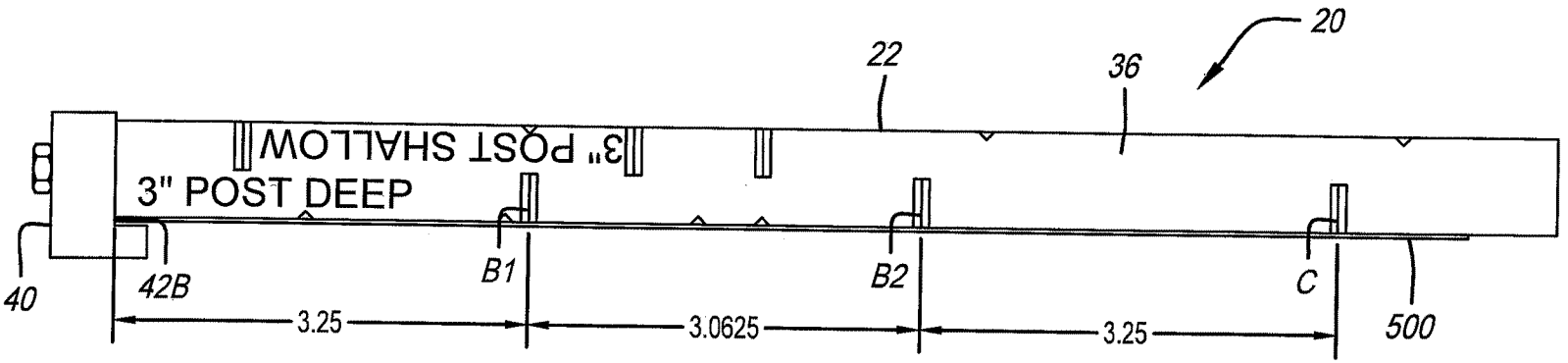
FIG. 16 is a side elevation view of a fourth face of the tool showing dimensions of marking stations.
Figure 16A:
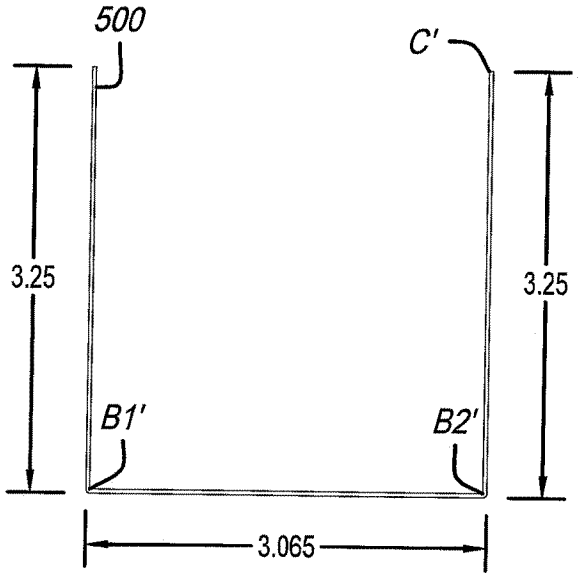
FIG. 16A is an end view of a piece of sheet metal which has been bent at the bend lines of FIG. 16.

In FIG. 16, scale 22 has been rotated 270° (from the position of FIG. 10) with respect to cross member 40 so that fouth face 36 is now perpendicular to sheet of metal 500. Three marking stations C, B1, and B2 and their dimensions are shown. FIG. 16A is an end view of a piece of sheet metal 500 which has been bent at the locations C', B1'. and B2' of the three marking stations of FIG. 16.

Figure 17B:
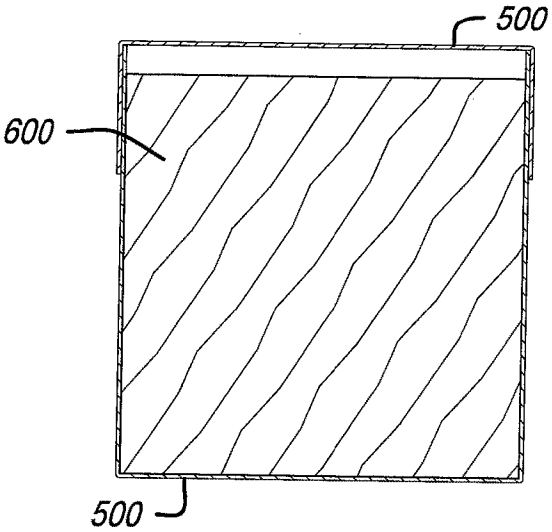
FIG. 17B is an end view of the piece of sheet metal of FIG. 17A and the piece of sheet metal of |FIG. 16A placed around a 3" by 3" wooden member.
Figure 17A:
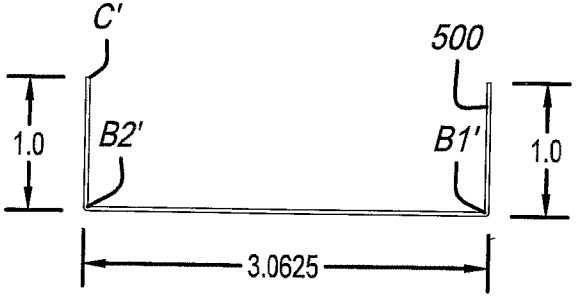
FIG. 17A is an end view of a piece of sheet metal which has been bent at the bend lines of FIG. 17.

In FIG. 17, scale 22 has been rotated 180° (from the position of FIG. 16) with respect to cross member 40 so that fourth face 36 is again perpendicular to sheet of metal 500, and is viewed from the opposite side. Three marking stations C, B1, and B2 and their dimensions are shown. FIG. 17A is an end view of a piece of sheet metal 500 which has been cut and bent at the locations C', B1'. and B2' of the three marking stations of FIG. 17. FIG. 17B shows the piece of sheet metal 500 of FIG. 16A and the piece of sheet metal 500 of FIG. 17A placed in overlapping relationship around a 3"×3" wooden member 600.

FIGS. 18-20 illustrate the process of marking a piece of sheet metal 500 in accordance with the present tool 20 and method. First scale 22 is rotated with respect to cross member 40 so that a desired face is disposed perpendicular to sheet of metal 500. Then in FIG. 18 at a first location, one of first surface 42A and second surface 42B is positioned in abutting contact with of edge 502 of sheet metal 500. A marking implement 700 (such as a pen) is then inserted into the marking station grooves and used to make a cut mark (C), a first bend mark (B1), and a second bend mark (B2) on sheet of metal 500. In FIG. 19 tool 20 is then moved to a second location (spaced apart from the first location) on sheet of metal 500. Marking implement 700 is used to make a second set of three marks on sheet of metal 500 cut (C), first bend (B1), and second bend (B2). The two sets of three marks are shown in FIG. 20. It is noted that with marker 700 placed at the marking stations 38 (C, B1, and B2), tool 20 can be moved back-and-forth (as shown by the arrows in FIG. 18) to create a short line for the C, B1, and B2 marks.

After the above described marking, as is well known in the art, a bending brake (not shown) is used to (1) cut the sheet of metal 500 at the cut line (C), (2) bend the sheet of metal 500 90° at the second bend line B2, and (3) bend the sheet of metal 500 90° at the first bend line (B1). After cutting and bending, the sheet of metal 500 will have a U-shape suitable for cladding a wooden member 600.

In more detailed terms of use, a method for marking sheet metal 500 includes: (refer to FIGS. 1-20)

(a) providing a sheet of metal 500 having an edge 502;

(b) providing a marking implement 700;

(c) providing a tool 20 for marking the sheet of metal 500, the tool 20 including;

a scale 22 having a first end 24, an opposite second end 26, a longitudinal axis 28, and four faces 30, 32, 34, and 36;

at least one of the four faces 30, 32, 34, and 36 including a cut marking station (C), a first bend marking station (B1), and a second bend marking station (B2);

a cross member 40 rotatably connected to the first end 24 of the scale 22, the cross member 40 having a surface 42 which is disposed perpendicular to the longitudinal axis 28;

(d) rotating the scale 22 so that a desired face is disposed perpendicular to the sheet of metal 500;

(e) at a first location on the sheet of metal 500, positioning the surface 42 of the cross member 40 into abutting contact with the edge 502 of the sheet of metal 500;

(f) using the marking implement 700 to make a cut mark (C), a first bend mark (B1), and a second bend mark (B2) on the sheet of metal 500;

(g) at a second location on the sheet of metal 500, positioning the surface 42 of the cross member 40 into abutting contact with the edge 502 of the sheet of metal 500; and, (h) using the marking implement 700 to make a cut mark (C), a first bend mark (B1), and a second bend mark (B2) on the sheet metal (500).

The method further including:

in (c), the flange 44 having a centrally disposed notch 46.

The method further including:

in (c), a screw 48 which rotatably connects the cross member 40 to the first end 24 of the scale 22, the screw 48 oriented along the longitudinal axis 28 of the scale 22; and, in (c), a nut 50 inset into the first end 24 of the scale 22, the nut 50 engaging the screw 48.

The method of further including:

in (c), the four faces 30, 32, 34, and 36 including a set of three marking stations 38, one marking station 38 being a cut (C), another marking station 38 being a first bend (B1), and another marking station 38 being a second bend (B2).

The method further including:

in (c) at least one face of the four faces 30, 32, 34, and 36 including two sets of three marking stations 38.

The method further including:

in (c), the marking stations including one marking station set for use with a 2" by 4" wooden member, one said marking station set for use with a 2" by 2" wooden member, two marking station sets for use with a 3" by 3" wooden member, and two marking station sets for use with a 4" by 4" wooden member.

The method further including:

in (c), one of said four faces including a set of exactly two marking stations, one marking station being a first bend, and another marking station being a second bend The embodiments of the tool and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the tool and method should be construed as limiting the invention to a particular embodiment or combination of embodiments. The scope of the invention is defined by the appended claims.

I claim:

1. A tool for marking sheet metal prior to bending in a bending brake, the sheet metal having an edge, the tool comprising:

a scale having a first end, an opposite second end, a longitudinal axis, and four faces, each of said four faces including a plurality of marking stations;

a cross member rotatably connected to said first end of said scale, said cross member having a surface which is disposed perpendicular to said longitudinal axis;

a screw which rotatably connects said cross member to said first end of said scale, said screw oriented along said longitudinal axis of said scale; and a nut inserted into said first end of said scale, said nut engaging said screw;

wherein the cross member rotates about the screw.

2. The tool according to claim 1 further including:

said surface including a first surface and a second surface spaced apart from said first surface;

a flange outwardly projecting parallel to said longitudinal axis from said surface; and, said second surface disposed between said scale and said flange.

3. The tool according to claim 1 further including:

said flange having a centrally disposed notch.

4. The tool according to claim 1 further including:

said plurality of marking stations being V-shaped notches.

5. The tool according to claim 1 further including:

said marking stations including a set of three marking stations, one marking station being a cut, another marking station being a first bend, and another marking station being a second bend.

6. The tool according to claim 5 further including:

at least one face of said four faces including two said sets of three marking stations.

7. The tool according to claim 5 further including:

said marking stations including one said marking station set for use with a 2" by 4" wooden member, one said marking station set for use with a 2" by 2" wooden member, two marking station sets for use with a 3" by 3" wooden member, and two marking station set for use with a 4" by 4" wooden member.

8. The tool according to claim 1 further including:

one of said four faces including a set of exactly two marking stations, one marking station being a first bend, and another marking station being a second bend.

9. The tool according to claim 1 further including:

said surface including a first surface and a second surface spaced apart from said first surface;

a flange outwardly projecting parallel to said longitudinal axis from said surface;

said second surface disposed between said scale and said flange;

said flange having a centrally disposed notch;

a screw which rotatably connects said cross member to said first end of said scale, said screw oriented along said longitudinal axis of said scale;

a nut inset into said first end of said scale, said nut engaging said screw;

said plurality of marking stations being V-shaped notches;

said marking stations including a set of three marking stations, one marking station being a cut, another marking station being a first bend, and another marking station being a second bend;

at least one face of said four faces including two said sets of three marking stations;

said marking stations including one said marking station set for use with a 2" by 4" wooden member, one said marking station set for use with a 2" by 2" wooden member, two marking station sets for use with a 3" by 3" wooden member, and two marking station set for use with a 4" by 4" wooden member; and, one of said four faces including a set of exactly two marking stations, one marking station being a first bend, and another marking station being a second bend.

10. A method for marking sheet metal comprising:

(a) providing a sheet of metal having an edge;

(b) providing a marking implement;

(c) providing a tool for marking said sheet of metal, said tool including;

a scale having a first end, an opposite second end, a longitudinal axis, and four faces;

at least one of said four faces including a cut marking station, a first bend marking station, and a second bend marking station;

a cross member rotatably connected to said first end of said scale, said cross member having a surface which is disposed perpendicular to said longitudinal axis;

(d) rotating said scale so that a desired face is disposed perpendicular to said sheet of metal;

(e) at a first location on said sheet of metal, positioning said surface of said cross member into abutting contact with said edge of said sheet of metal;

(f) using said marking implement to make a cut mark, a first bend mark, and a second bend mark on said sheet of metal;

(g) at a second location on said sheet of metal, positioning said surface into abutting contact with said edge of said sheet of metal; and, (h) using said marking implement to make a cut mark, a first bend mark, and a second bend mark on said sheet metal.

11. The method of claim 10 further including:

in (c), said flange having a centrally disposed notch.

12. The method of claim 10 further including:

in (c), a screw which rotatably connects said cross member to said first end of said scale, said screw oriented along said longitudinal axis of said scale; and, in (c), a nut inset into said first end of said scale, said nut engaging said screw.

13. The method of claim 10 further including:

in (c), said four faces including a set of three marking stations, one marking station being a cut, another marking station being a first bend, and another marking station being a second bend.

14. The method of claim 13 further including:

in (c) at least one face of said four faces including two said sets of three marking stations.

15. The method of claim 13 further including:

in (c), said marking stations including one said marking station set for use with a 2" by 4" wooden member, one said marking station set for use with a 2" by 2" wooden member, two marking station sets for use with a 3" by 3" wooden member, and two marking station set for use with a 4" by 4" wooden member.

16. The method of claim 10 further including:

in (c), one of said four faces including a set of exactly two marking stations, one marking station being a first bend, and another marking station being a second bend.

17. A method for marking sheet metal comprising:

(a) providing a sheet of metal having an edge;

(b) providing a marking implement;

(c) providing a tool for marking said sheet of metal, said tool including;

a scale having a first end, an opposite second end, a longitudinal axis, and four faces;

at least one of said four faces including a cut marking station, a first bend marking station, and a second bend marking station;

a cross member rotatably connected to said first end of said scale, said cross member having a surface which is disposed perpendicular to said longitudinal axis;

(d) rotating said scale so that a desired face is disposed perpendicular to said sheet of metal;

(e) at a first location on said sheet of metal, positioning said surface of said cross member into abutting contact with said edge of said sheet of metal;

(f) using said marking implement to make a first bend mark, and a second bend mark on said sheet of metal;

(g) at a second location on said sheet of metal, positioning said surface into abutting contact with said edge of said sheet of metal; and, (h) using said marking implement to make a a first bend mark, and a second bend mark on said sheet metal.

* * * * *